US005803449A

United States Patent [19]

Koga et al.

[11] Patent Number: 5,803,449

[45] Date of Patent: Sep. 8, 1998

[54] AUTOMATIC MANUSCRIPT SHEET FEEDER

[75] Inventors: Ritsuo Koga; Kouichi Minami, both of Tokyo, Japan

[73] Assignee: Plus Corporation, Tokyo, Japan

[21] Appl. No.: 523,338

[22] Filed: Sep. 5, 1995

[30] Foreign Application Priority Data

Sep. 14, 1994 [JP] Japan ..... 6-247013

[51] Int. Cl.[6] ..... B65H 9/16

[52] U.S. Cl. ..... 271/249; 271/248; 271/250

[58] Field of Search ..... 271/248–251, 271/188

[56] References Cited

U.S. PATENT DOCUMENTS

| | | | |
|---|---|---|---|
| 2,904,155 | 9/1959 | Hempel | 271/248 |
| 2,938,723 | 5/1960 | Paulson | 271/250 |
| 3,415,509 | 12/1968 | Tyburski et al. | 271/248 |
| 3,521,880 | 7/1970 | Shebanow et al. | 271/250 |
| 4,374,586 | 2/1983 | Lamos et al. | 271/117 |
| 4,836,527 | 6/1989 | Wong | 271/248 |
| 4,943,044 | 7/1990 | Roscart | 271/248 |
| 5,004,220 | 4/1991 | Dreshel et al. | 271/248 |
| 5,226,643 | 7/1993 | Kriegel et al. | 271/250 |
| 5,280,903 | 1/1994 | Herrick, Jr. | 271/251 |

FOREIGN PATENT DOCUMENTS

| | | | |
|---|---|---|---|
| 2255474 | 10/1990 | Japan . | |
| 564622 | 10/1944 | United Kingdom | 271/55 |

*Primary Examiner*—William E. Terrell
*Assistant Examiner*—Khoi H. Tran

[57] ABSTRACT

The present invention discloses an automatic sheet feeder to feed manuscript sheets onto and discharge the same from the top of the stage on the overhead projector. The automatic sheet feeder comprises a side guide plate disposed at the top of a side edge of the stage, a bottom plate forming a manuscript set window together with the side guide plate, a side plate perpendicular to the side guide plate, a plurality of side feeding rollers for forward and backward rotations supported by the above side plate, and notches formed at the above side guide plate immediately below these rollers to accept the manuscript sheet whose side edge is pressed downward by the outer circumference of the side feeding rollers.

4 Claims, 5 Drawing Sheets

FIG. 7(A)
CONVENTIONAL
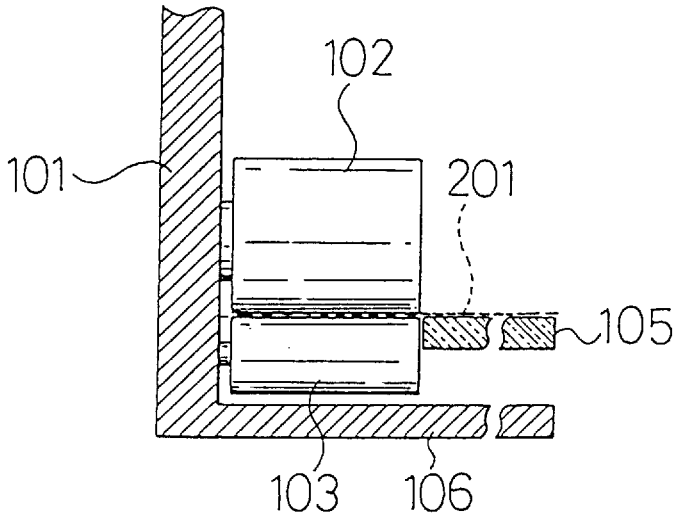
FIG. 7(B)
CONVENTIONAL
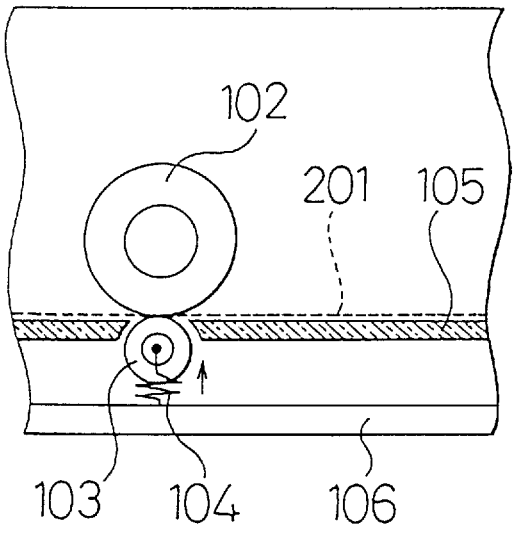

AUTOMATIC MANUSCRIPT SHEET FEEDER

BACKGROUND OF THE INVENTION (1) Field of the Invention

The present invention relates to an automatic manuscript sheet feeder to be used in the overhead projector (hereinafter referred to as OHP), and more particularly relates to an automatic sheet feeder with an improved manuscript feeding/discharging mechanism for transmission or reflection type overhead projectors.

(2) Description of the Related Art

It is well known that there are two types of overhead projectors: the transmission type where the light through the manuscript is projected and the reflection type where the light reflected by the manuscript is projected.

In the transmission type OHP, the light source is positioned under the stage glass where the manuscript is placed and the light through the manuscript is collected by the projection lens and projected to the screen. With the transmission type OHP, even when some gap exists between the stage glass and the manuscript, the projection image can be made practically clear by adjustment of the projection lens focus on the manuscript.

On the other hand, the reflection type OHP uses a Fresnel lens with reflective coating as the stage. The manuscript on the stage is lighted by the light source near the projection lens and the light reflected by the manuscript is collected by the projection lens and projected to the screen.

With this type of OHP, the light from the light source may move to and fro in any gap between the Fresnel lens surface and the manuscript the gap. This may result in double projection images even when the projection lens focusing is adjusted.

FIGS. 7 (A) and 7 (B) the major parts of a conventional manuscript sheet feeder for a transmission type OHP. FIG. 7 (A) is a front view and (B) is a side view. In this automatic manuscript sheet feeder, the side edge of the manuscript 201 to be fed to the OHP (not shown) is caught between the feeding roller 102 and the supporting roller 103 so that the manuscript 201 is carried by the feeding roller 102 driven by a driving mechanism.

In FIG. 7 (A), reference numeral 101 indicates a side plate of the base. In FIG. 7 (B), the reference numeral 104 indicates a spring which presses the support roller 103 against the feed roller 102 and 105 indicates a stage glass of the automatic sheet feeder and 106 indicates a bottom plate of the base.

The conventional automatic manuscript sheet feeder as described above involves some drawbacks when used with the reflection type OHP. Because of its structure where the manuscript 201 is carried between the feeding roller 102 and the supporting roller 103, the face of the manuscript 201 is largely separated from the surface of the Fresnel lens (not shown) below the bottom plate 106. This results in images out of focus, which cannot be used in practical applications.

In addition, whether the OHP is of transmission type or reflection type, the edge of the manuscript 201 may be lifted off the stage (floating) and caught by the edge of the discharging guide plate adjacent to the stage during discharging of the manuscript 201. This impedes smooth discharge of the manuscript 201.

Another prior art of the present invention is an automatic manuscript sheet feeder disclosed in the Japanese Patent Application Laid-open No. 255474/1990.

A conventional manuscript sheet feeder according to the above invention comprises a feeding means having at least a pair of carrying belts for each of vertical and horizontal manuscript sheets located around the stage glass, a detection means to detect the manuscript direction (vertical or horizontal) and a manuscript feeding amount control means.

A horizontal manuscript placed on the stage glass is carried forward or backward with a pair of carrying belts arranged on both sides of the stage glass (Left and right of the manuscript feeding direction).

In this prior art, if the rotation speeds of the carrying belts are not correctly the same, the left and right edges of the manuscript are carried at different speeds. This causes distortion and float in a part of the manuscript, which may result in unclear OHP image.

On the other hand, the user may sometimes want to manually set the manuscript on the stage glass without using the automatic mechanism. In such case, the carrying belts on the both sides of the stage glass in the above conventional feeder interferes with manual manuscript setting.

The carrying belts are in contact with a large area in the manuscript on the stage glass to take advantage of the frictional force on the contact face for manuscript carrying. This contact tends to damage the manuscript. In addition, a pair of carry belts and their driving mechanisms require many components.

Still another prior art is a sheet plate making device disclosed in the U.S. Pat. No. 5,280,903.

This sheet plate making device comprises a tilt table having an upstream end at a higher position and a downstream end at a lower position on its surface, a plurality of discs having surfaces continuous to the table surface, a plurality of rotatable balls opposite to these discs and an edge guide to regulate the sheet direction straightly. By feeding sheets from the above upstream end onto the table and applying rotational force to the back of the sheet with the above discs, the sheet direction is corrected so that the sheet edge goes along the edge guide.

This prior art device is designed to carry sheets between two devices (printer and another device, for example). It is not particularly provided as a manuscript sheet feeder for OHP. In addition, unique ideas such as a tilt table and a rotational discs incorporated in the table according to this prior art cannot be applied as they are to a manuscript sheet feeder for OHP.

Thus, it is an object of the present invention to provide an automatic manuscript sheet feeder which realizes clear projection images whether the OHP is of transmission type or reflection type.

It is another object of the present invention to provide an automatic manuscript sheet feeder which can smoothly discharge the manuscript.

It is another object of the present invention to provide an automatic manuscript sheet feeder which prevents distortion, wrinkles or damage of the fed manuscript.

It is still another object of the present invention to provide an automatic manuscript sheet feeder which facilitates manual setting of manuscript sheets.

It is still another object of the present invention to provide an automatic manuscript sheet feeder which requires reduced power consumption and realizes a longer service life for the rollers.

BRIEF SUMMARY OF THE INVENTION

An automatic manuscript sheet feeder of the present invention to attain the above objects comprises a side guide plate positioned on a side edge of the OHP stage, a bottom plate which forms a manuscript set window with the side guide plate, a side plate perpendicular to the above side guide plate, a plurality of side feeding rollers for forward and backward rotations supported at the axis by the guide plate to carry the manuscript in both forward and backward directions and notches formed at the side guide plate immediately below these side feeding rollers to accept the manuscript with its side edge pressed downward by the outer circumference of the side feeding rollers.

Other objects, characteristics and advantages of the present invention will become more apparent in the description below with referring to the attached drawings.

BRIEF DESCRIPTION OF THE DRAWINGS

FIG. 7 (A) is a front view and FIG. 7 (B) is a side view of the major part in a conventional manuscript sheet feeder according to the prior art.

DETAILED DESCRIPTION OF THE INVENTION

Figure 1:
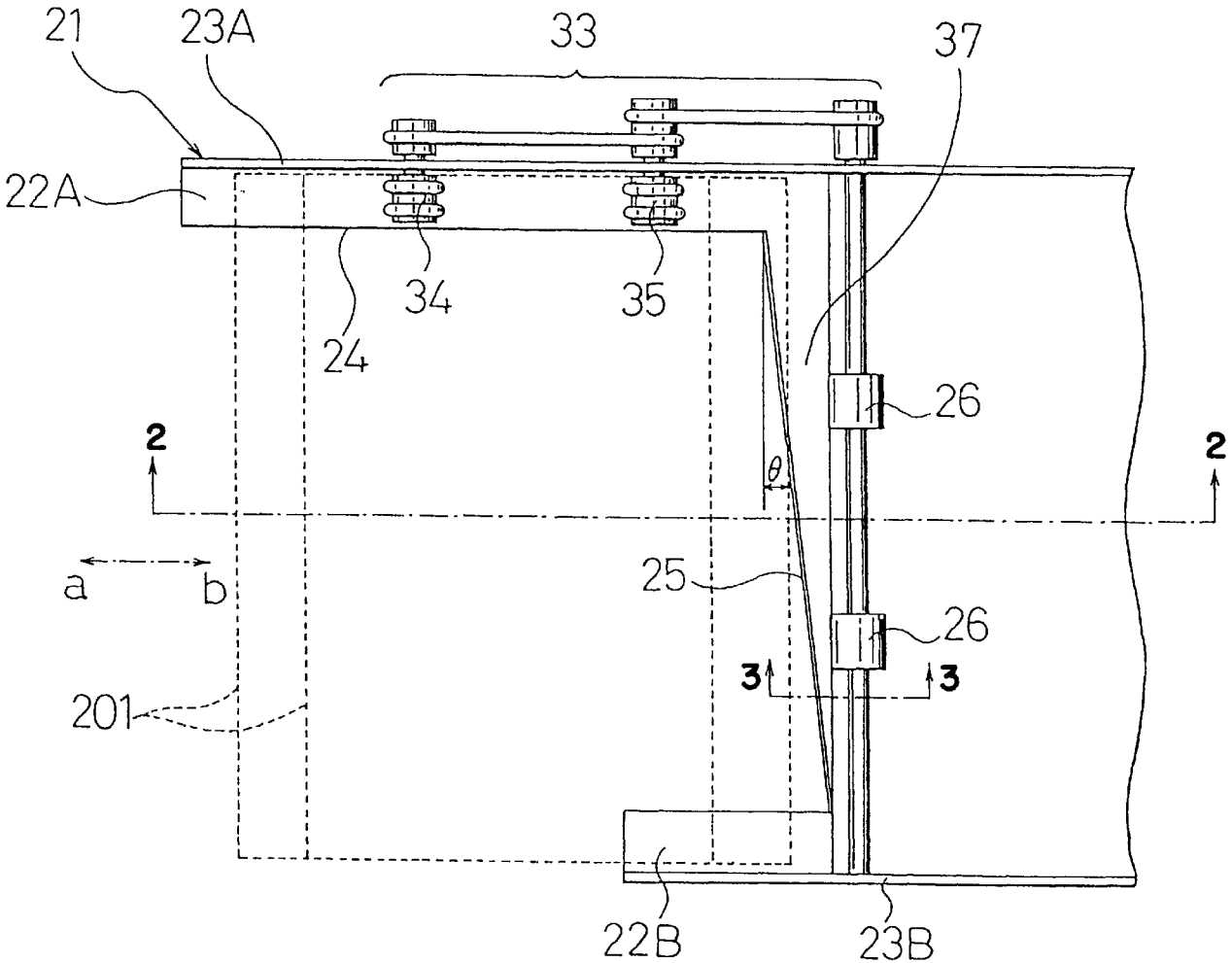
FIG. 1 is a plan view of the major part in a preferred embodiment according to the present invention.

Referring to FIG. 1, reference numeral 21 indicates a base placed on the stage face (not shown) of the OHP. The base 21 is provided with a side plate 23A positioned at the right (upper side in the figure) of the feeding direction (shown by arrow a) of a manuscript 201 and a long side guide plate 22A perpendicular to the side plate 23A. It is also provided with a side plate 23B positioned at the right (lower side in the figure) of the feeding direction of the manuscript 201 and a short side guide plate 22B perpendicular to the side plate 23B.

The side guide plates 22A and 22B are connected by a bottom plate 37. The bottom plate 37 has an angled edge 25 which obliquely crosses the edge of the manuscript 201 with an angle theta on a plane.

The inner edges of the side guide plates 22A and 22B and an angled edge 25 which is continuous from these internal edges form a manuscript set window 24. The manuscript set window 24 coincides with the OHP stage face (not shown). In other words, guide plate 22A on one side is disposed on a side edge of the stage and the other side guide plate 22B is disposed on the other side edge of the stage.

Thus, the automatic manuscript sheet feeder according to this embodiment is set onto the OHP with its manuscript set window 24 coinciding with the OHP stage face.

At the back of the angled edge 25, a pair of feeding rollers 26 and 26 are provided.

Figure 2:
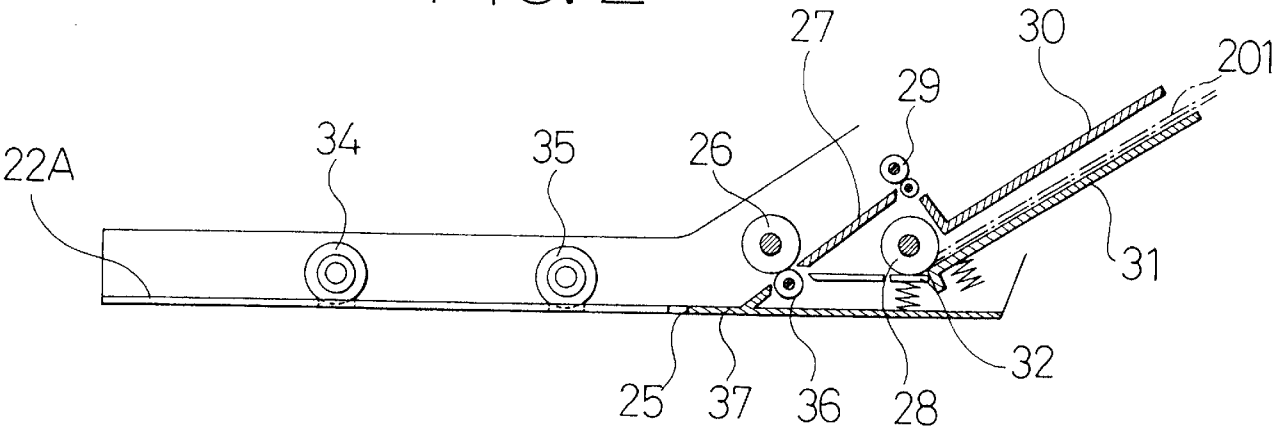
FIG. 2 is a cross sectional view of the major part in FIG. 1 along the line 2—2.

Referring to FIG. 2, a supporting roller 36 is positioned immediately below the feeding roller 26. Upstream of the feeding roller 26, a discharge roller 29 and a separating roller 28 are disposed on and under the discharge guide plate 27 for manuscript discharge. At the back of the separating roller 28, a manuscript receiver 30 and a manuscript tray 31 are mounted.

The sheets of the manuscript 201 are placed on the manuscript tray 31. The separating roller 28 and a separating plate 32 pressed against its lower face catch the manuscript sheets one by one and carry them toward the feeding rollers 26. After setting and projection at the manuscript set window 24, the sheets of the manuscript 201 are carried by the feeding rollers 26 making backward rotations on the discharge guide plate 27 and stored in the manuscript receiver 30 via the discharge roller 29.

The carriage, guiding and discharge mechanisms for the manuscript 201 at the back of the feeding rollers 26 are not essential in the present invention, and their detailed description is omitted here.

Figure 3:
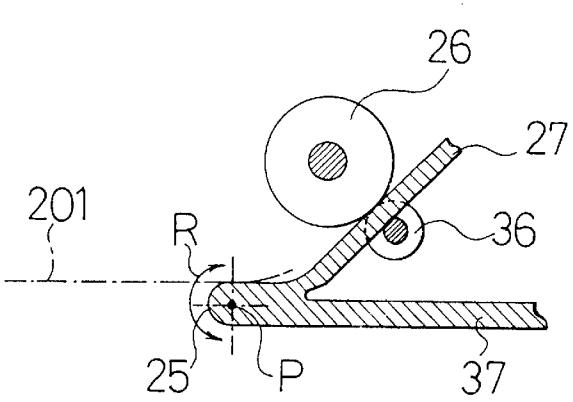
FIG. 3 is an enlarged cross sectional view of the major part in FIG. 1 along the line 3—3.

FIG. 3 is an enlarged cross-sectional view of the embodiment in FIG. 1 along the line 3—3.

The cross section of the angled edge 25 has a semicircular shape with an arc projected on the side of the manuscript set window 24. This shape is helpful for smooth discharge of the manuscript 201 toward the feeding rollers 26 by preventing its leading edge from being caught by the angled edge 25.

The cross section of the angled edge 25 is not necessarily shaped as an exact semicircle, but it is preferable that it has at least a curved face projecting toward the manuscript set window 24 in range R of 180 degrees around Point P in FIG. 3.

The angled edge 25 with such a cross section is, as shown in FIG. 3, formed as a one piece with the bottom plate 37 and the discharge guide plate 27 using the same material (plastic, for example). Alternatively, these components may be formed by fixing a bar of aluminum or other materials with a certain curved face to the edge of the bottom plate 37.

Referring again to FIG. 1, the automatic manuscript sheet feeder is provided with feeding rollers 26 and a driving mechanism 33 for side feeding roller 34 and 35 (described later) at the outer side of the side plate 23A. The driving mechanism 33 comprises sprockets and belts to transmit revolutions of a motor (not shown) and a known gear mechanism. It rotates the feeding rollers 26 and side feeding rollers 34 and 35 synchronously.

Figure 4A:
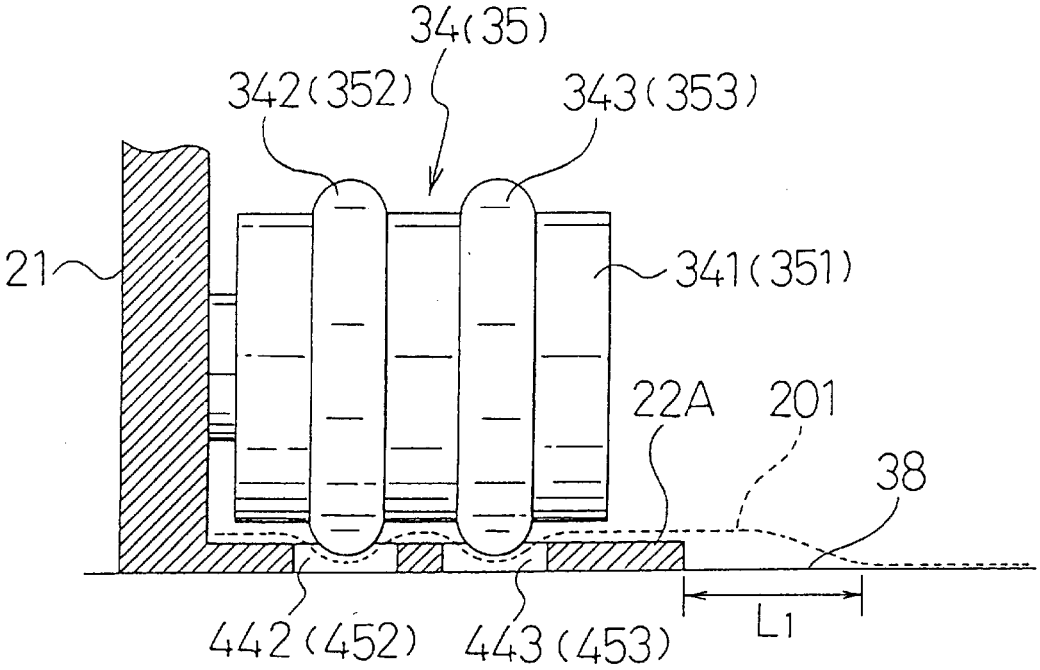
FIG. 4 (A) is a front view and FIG. 4 (B) is a plan view of the side feeding rollers and their peripheral structures in the embodiment of FIG. 1.
Figure 4B:
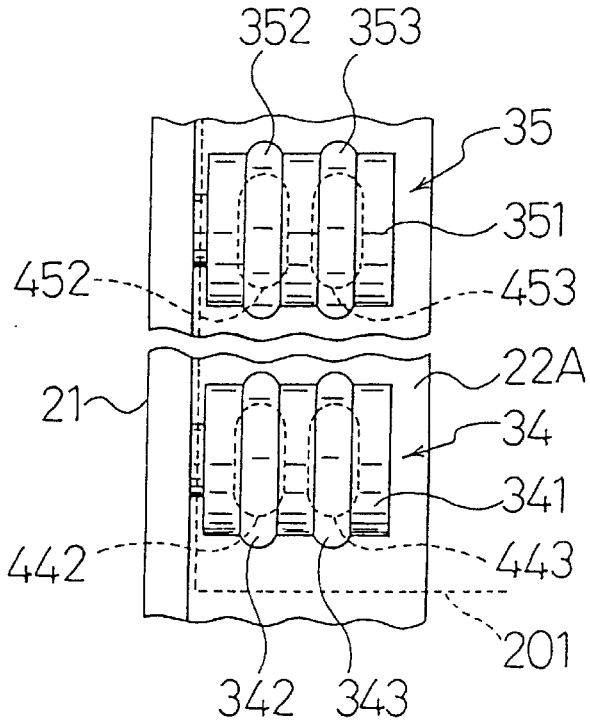

Referring now to FIG. 4, the structure of the side feeding rollers 34 and 35 and the part around them are described below.

The side feeding rollers 34 and 35 have the same structure. FIG. 4 (A) shows one of them (34). The numbers in ( ) following the numerals for the side feeding rollers 34 indicate the corresponding members of the other side feeding roller 35.

The side feeding rollers 34 and 35 comprise a pair of column-shaped rollers 341 or 351 and manuscript feeding rings 342, 343 or 352, 353 made of rubber or other materials mounted to these rollers 341, 351.

The side guide plate 22A positioned immediately below the manuscript feeding rings 342, 343, 352, 353 is provided with notches 442, 443, 452, 453 to receive the maximum outer diameter of the manuscript feeding rings 342, 343, 352, 353.

A gap is kept between the rollers 341, 351 and the surface of the side guide plate 22A so that a sheet of manuscript 201 can be inserted.

A single roller may have three manuscript feeding rings or a wide feeding ring. The manuscript feeding ring and the roller may be formed as one piece using rubber or other materials.

Further, three or more side feeding rollers may be disposed along the length of the side guide plate 22A.

The automatic manuscript sheet feeder according to this embodiment operates as described below.

In FIG. 1, a sheet of the manuscript 201 carried by the feeding rollers 26 and 26 under the weight of itself proceeds toward the side feeding roller 35 with its side edges contacting with the side guide plates 22A and 22B. When the leading edge of the manuscript 201 reaches the point immediately below the side feeding roller 35, as shown in FIG. 4 (A), the manuscript feeding rings 352 and 353 press that edge against the inside of the notches 452 and 453 and carry the manuscript 201 toward the other side feeding roller 34.

Then, when the leading edge of the manuscript 201 reaches the point immediately below the side feeding roller 34, the leading edge of the manuscript 201 is similarly pressed against the inside of the notches 442 and 443 by the manuscript feeding rings 342 and 343 and the manuscript 201 is continuously carried.

The size of the manuscript 201 can be detected by known means such as an optical sensor. By stopping the side feeding rollers 34 and 35 at a predetermined timing, the manuscript 201 can be stopped at the predetermined position in the manuscript set window 24, or at the position coinciding with the OHP stage face. In addition, by causing forward and backward rotations with small strokes at the side feeding rollers 34 and 35, the manuscript position can be finely adjusted as shown in FIG. 1 in broken lines.

When the manuscript 201 is carried, as shown in FIG. 4 (A), the manuscript 201 is held by the inner edge of the notches 442, 443, 452, 453 and pressed by the manuscript rings 342, 343, 352, 353. Thus, the manuscript 201 can be sufficiently gripped without a supporting roller as shown in FIG. 7. The manuscript 201 can be securely carried without idle rotations of the side feeding rollers 34 and 35.

In FIG. 4 (A), reference numeral 38 is an OHP stage face which comprises the Fresnel lens surface and the stage glass surface.

In this embodiment, the side feeding rollers 34 and 35 at one side of the direction for carrying the manuscript 201 (direction of arrow a or b in FIG. 1) serve for two-point support in feeding of the manuscript 201. In other words, the other side (on the side guide plate 22B) of the manuscript 201 is always kept free. In contrast to carrying by rollers on both sides of the manuscript 201, the manuscript 201 is substantially free from distortion, wrinkles or other damage, and its flatness is securely kept.

For manual setting of the manuscript 201 to the OHP, a sufficient space for manuscript insertion/discharge can be provided on the side of the side guide plate 22B. It is very convenient for manual feeding.

In this embodiment, the feeding rollers 26 and the side feeding rollers 34 and 35 make rotations at the same time. Thus, when the manuscript 201 is fed in the direction of arrow a in FIG. 1, for example, the side feeding rollers 34 and 35 are rotating even without the leading edge of the manuscript 201 sent out from the feeding rollers 26 arriving at the side feeding roller 35. The side feeding rollers 34 and 35 are rotating under no load in this process. In contrast to the structure shown in FIG. 7 where the feeding roller 102 makes rotation in press contact with the supporting roller 103, this embodiment realizes lower power consumption and lower abrasion at the side feeding rollers 34 and 35.

The manuscript 201 after projection at the predetermined position in the manuscript set window 24 is fed toward the feeding rollers 26 by backward rotations of the side feeding rollers 34 and 35.

As described above, the bottom plate 37 is provided with the angled edge 25. The leading edge of the manuscript 201 makes contact with the angled edge 25 at a point and then is promptly guided by the discharge guide plate 27 to proceed slightly upward toward the feeding rollers 26. Thus, even when the manuscript 201 has any warp or bending, it can be smoothly discharged.

Figure 5:
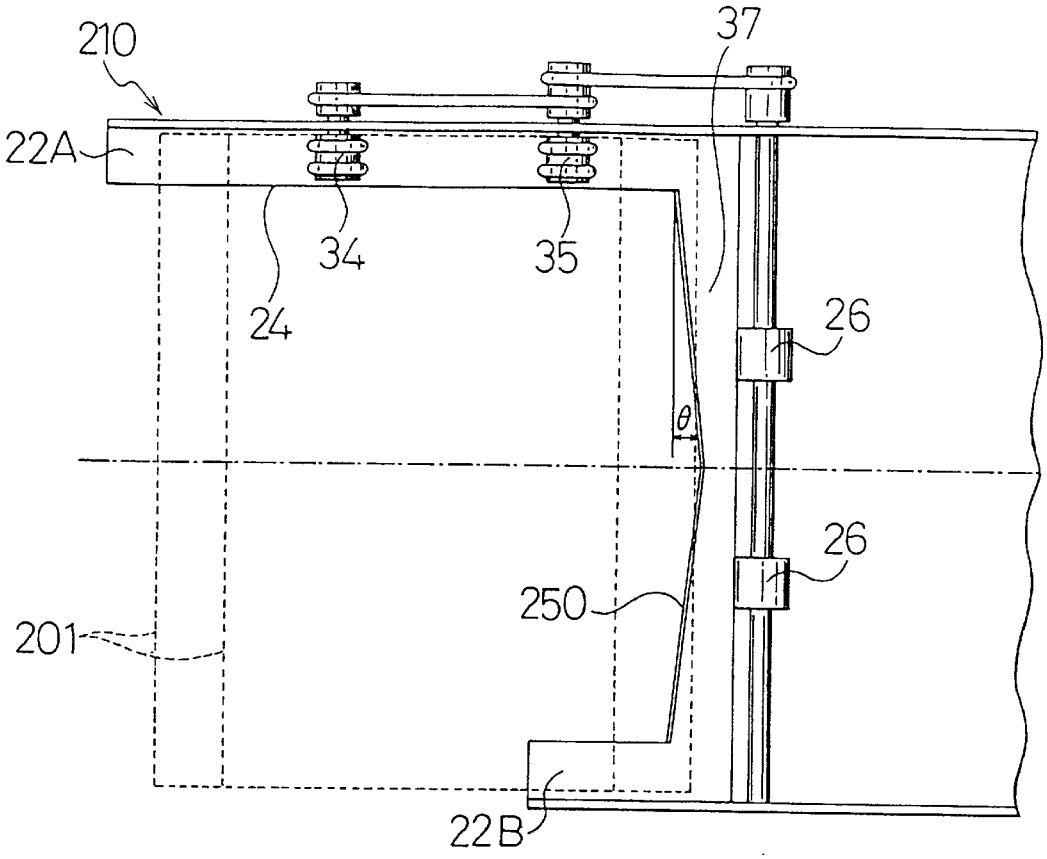
FIG. 5 is a plan view of the major part in another preferred embodiment according to the present invention.

Referring now to FIG. 5 to show another embodiment of the present invention, the angled edge 250 is, when seen in a plan view, shaped like a letter of V with its center positioned substantially at the center of the width of the bottom plate 37. It is preferable that the angled edge 250 in this embodiment is also provided with a curved face projecting toward the manuscript set window 24.

According to this embodiment, the manuscript 201 can be smoothly discharged under the effect of the angled edge 250 as in the case of the embodiment shown in FIG. 1.

Figure 6:
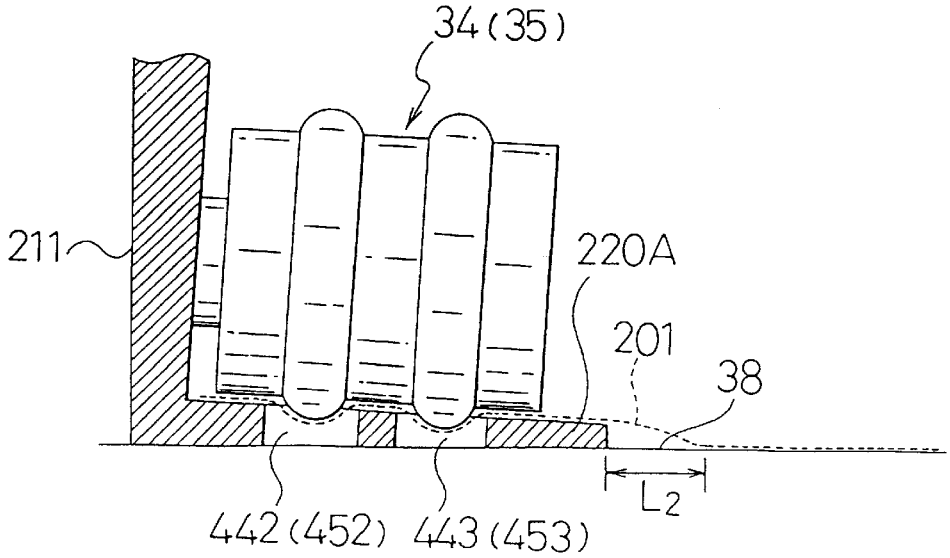
FIG. 6 is a front view of the major part in still another preferred embodiment according to the present invention.

FIG. 6 shows still another embodiment of the present invention. In this embodiment, a side guide plate 220A immediately below the side feeding rollers 34 and 35 is taper-shaped so that it becomes thinner toward the inside. Thus, length L2 from the inner edge of the side guide plate 220A to the point where the manuscript 201 makes contact with the OHP stage face 38 can be made shorter than length L1 in FIG. 4 (A). This results in a shorter distance between the manuscript 201 and the OHP stage face 38.

The embodiments described so far have a structure where the side feeding rollers 34 and 35 press a side edge of the manuscript 201 from the top for feeding. They are not structured as in FIG. 7 where the manuscript 201 is caught between the upper and the lower rollers for feeding. In other words, it is not necessary to provide a space to dispose another roller below the side feeding rollers 34 and 35. This results in a shorter distance below the side feeding rollers 34 and 35. When the structure according to the present invention is applied to the reflection type OHP, the distance between the manuscript and the Fresnel lens can be made shorter. Thus, the automatic manuscript sheet feeder is free from double projection images and can realize distinct images. The present invention can be also applied to the transmission type OHP.

Further, since the side feeding rollers 34 and 35 and its driving mechanism 33 operate under lower loads, it is possible to save power and to provide a longer service life for the rollers 34 and 35.

Since the manuscript 201 is fed with its one side supported by the side feeding rollers 34 and 35, it is less vulnerable to wrinkles and distortion than the manuscript transferred with its both sides contacting with the rollers. In addition, the angled edge 25 or 250 formed in the discharge direction of the manuscript 201 is quite helpful for smooth discharge of the manuscript 201.

It is to be understood that the foregoing relates to preferred embodiments to clearly show the technical contents of the present invention. It is obvious that the present invention is not limited to the above embodiments and various changes and modifications can be made to the invention without departing from the spirit and scope of the invention as hereinafter claimed.

We claim:

1. An automatic manuscript sheet feeder comprising:

a side guide plate fixedly positioned on a side edge of an overhead projector display stage, a bottom plate which forms a manuscript set window with said side guide plate adjacent said display stage, and a side plate perpendicular to said side guide plate, a plurality of side feeding rollers, each of said feeding rollers having an outer circumference and each of said feeding rollers having a rotational axis supported by said side plate to carry the manuscript in both forward and backward directions, wherein said side guide plate has a plurality of elongated receiving notches formed therein immediately below said side feeding rollers to receive the manuscript with its side edge pressed downward by the outer circumference of each of said feeding rollers.

2. The automatic manuscript sheet feeder of claim 1, wherein said bottom plate extends from an inner edge of one end portion of said side guide plate across and above said display stage, said bottom plate having an inward facing edge angled to the inner edge of said side guide plate.

3. The automatic manuscript sheet feeder of claim 2, wherein said angled inward facing edge has a cross section with a curved face projecting toward the manuscript set window.

4. The automatic manuscript sheet feeder of claim 1, wherein each of said outer circumferences has a feeding ring corresponding to and engageable with at least one of said plurality of notches.

* * * * *